US010310431B2

(12) United States Patent
Kusunoki et al.

(10) Patent No.: US 10,310,431 B2
(45) Date of Patent: Jun. 4, 2019

(54) IMAGE FORMING DEVICE

(71) Applicant: KONICA MINOLTA, INC., Chiyoda-ku, Tokyo (JP)

(72) Inventors: Takahiro Kusunoki, Hino (JP); Katsuya Toyofuku, Hino (JP); Kimio Nishizawa, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 253 days.

(21) Appl. No.: 15/460,573

(22) Filed: Mar. 16, 2017

(65) Prior Publication Data

US 2017/0269530 A1 Sep. 21, 2017

(30) Foreign Application Priority Data

Mar. 16, 2016 (JP) ..... 2016-051915

(51) Int. Cl.
*G03G 15/00* (2006.01)

(52) U.S. Cl.
CPC ..... *G03G 15/5062* (2013.01)

(58) Field of Classification Search
CPC ..... G03G 15/5062
See application file for complete search history.

(56) References Cited

U.S. PATENT DOCUMENTS 4,230,785 A * 10/1980 Carlson ..... G03G 5/10 283/81
9,341,978 B2 * 5/2016 Sato ..... G03G 15/043
2011/0102485 A1 * 5/2011 VanDemark ..... B41J 3/4075 347/8
2011/0102840 A1 * 5/2011 Kiriyama ..... G03G 15/50 358/1.15
2014/0363195 A1 * 12/2014 Okazaki ..... G03G 21/0011 399/101

FOREIGN PATENT DOCUMENTS

JP 2008266012 A 11/2008
JP 2015135399 A 7/2015
JP 2015158577 A 9/2015

* cited by examiner

*Primary Examiner* — Jill E Culler
(74) *Attorney, Agent, or Firm* — Cantor Colburn LLP

(57) ABSTRACT

An image forming device includes: an image forming section configured to form an image onto a recording medium in which sheets are laminated via an adhesive layer; a detection unit configured to detect an amount of an adhesive adhered beyond both edges of the recording medium in a width direction orthogonal to a transport direction; and a control unit configured to calculate a correction amount for correcting an image formation condition for the image forming section on the basis of a difference in the amount of the adhesive on both edges of the recording medium in the width direction detected by the detection unit.

11 Claims, 12 Drawing Sheets

IMAGE FORMING DEVICE

CROSS REFERENCE TO RELATED APPLICATIONS

The entire disclosure of Japanese Patent Application No. 2016-051915 filed on Mar. 16, 2016 including description, claims, drawings, and abstract are incorporated herein by reference in its entirety.

BACKGROUND OF THE INVENTION

Field of the Invention

The present invention relates to an image forming device.

Description of the Related Art

Conventionally, an electrophotographic image forming device including an image forming unit that forms a toner image on an image carrying body, and a transfer unit that primarily transfers the toner image on the image carrying body onto an intermediate transfer belt and secondarily transfers the intermediate toner image on the intermediate transfer belt onto a recording medium is known.

In the image forming device, a poor image or an internal device failure may occur due to an adhesive adhering to each member (such as a transport roller and a secondary transfer roller) when a recording medium such as a label sheet, in which sheets are laminated via an adhesive layer, is used.

Accordingly, a configuration including a removing member that detects adhesion of an adhesive and removes the same, is proposed (for example, refer to JP 2008-266012 A).

In addition, an image forming device generally includes various detection sensors that each detect image density or the position of a recording medium (for example, refer to JP 2015-135399 A and JP 2015-158577 A). Therefore, corrections are made using the detection results of these sensors when, for example, a gradient in the image density, positional displacement of an image, a meandering and an inclination of a recording medium occur because of the adhesion of the adhesive.

However, a removing member for removing an adhesive and various detection sensors for detecting image density or a position of a recording medium are needed in such an image forming device. As a result, there are a large number of components in such an image forming device.

SUMMARY OF THE INVENTION

The present invention has been made in view of such matters, and an object of the invention is to provide an image forming device capable of achieving good image quality and transport stability even with a small number of components.

To achieve the abovementioned object, according to an aspect, an image forming device reflecting one aspect of the present invention comprises: an image forming section configured to form an image onto a recording medium in which sheets are laminated via an adhesive layer; a detection unit configured to detect an amount of an adhesive adhered beyond both edges of the recording medium in a width direction orthogonal to a transport direction; and a control unit configured to calculate a correction amount for correcting an image formation condition for the image forming section on the basis of a difference in the amount of the adhesive on both edges of the recording medium in the width direction detected by the detection unit.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

First, a configuration of an image forming device in the present embodiment will be described.

Figure 1:
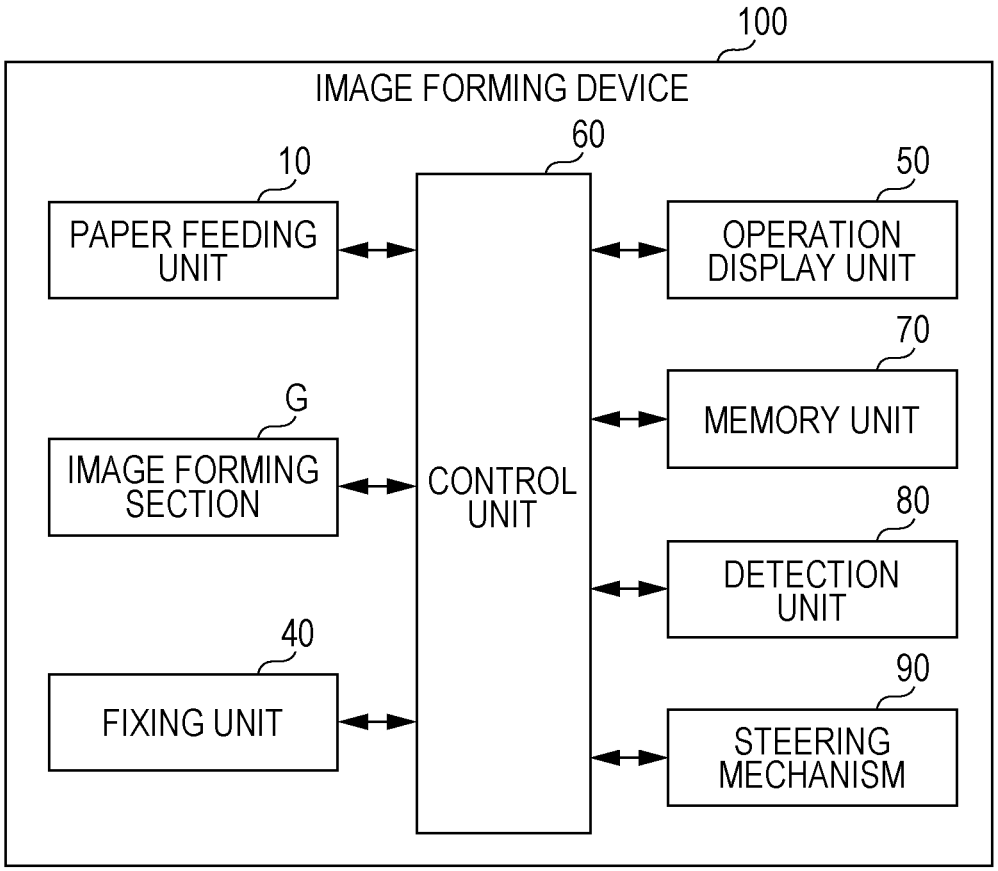
FIG. 1 is a functional block diagram illustrating a configuration of control of an image forming device.
Figure 2:
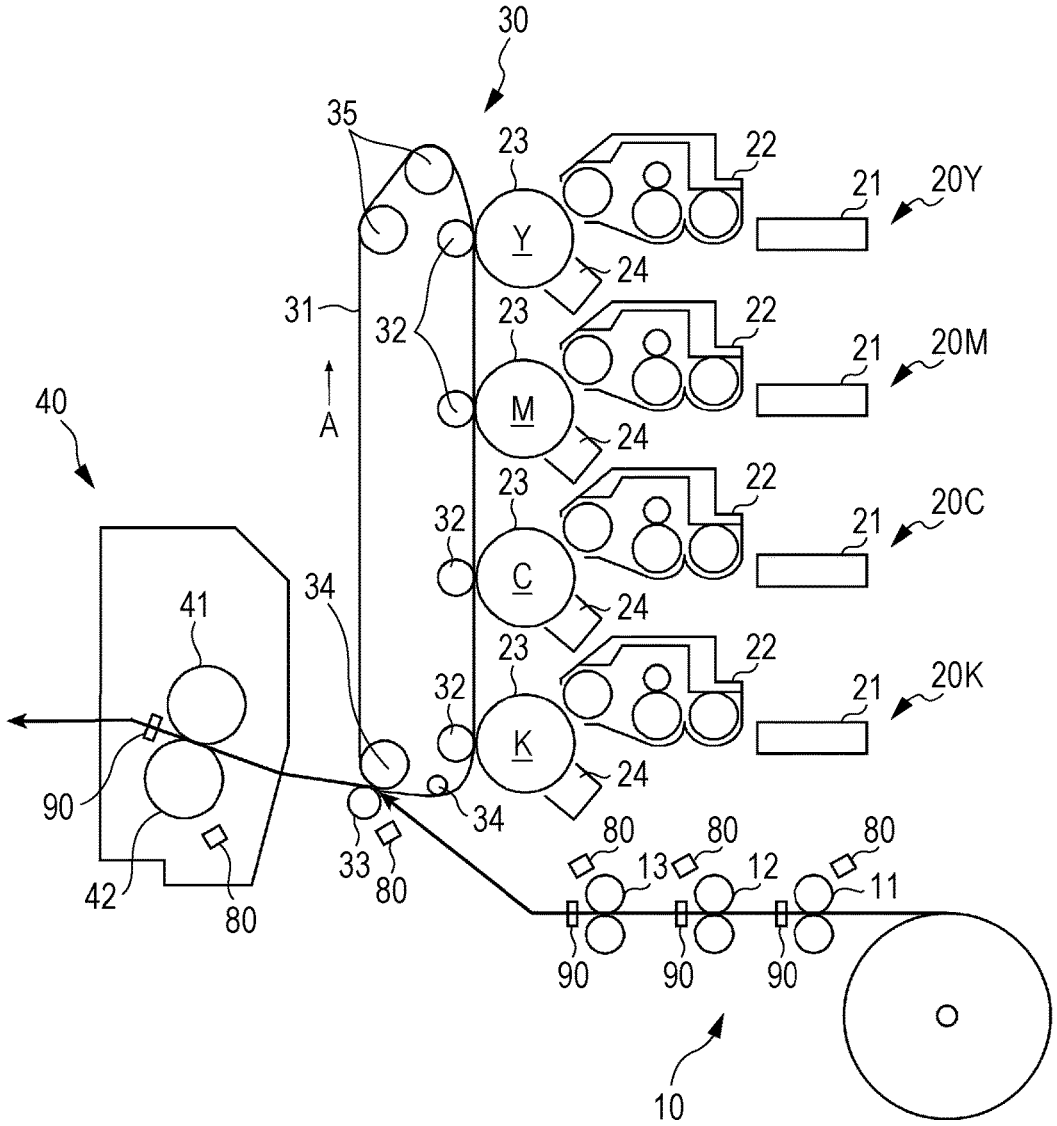
FIG. 2 is a schematic diagram illustrating a structure of main sections of the image forming device.

FIG. 1 is a functional block diagram illustrating a configuration of control of an image forming device 100. FIG. 2 is a schematic diagram illustrating a structure of main sections of the image forming device 100.

As illustrated in FIGS. 1 and 2, the image forming device 100 includes, for example, a paper feeding unit 10, an image forming section G, a fixing unit 40, an operation display unit 50 as a notification unit, a control unit 60, a memory unit 70, a detection unit 80, and a steering mechanism 90.

The paper feeding unit 10 includes a long recording medium P, which is wound into a roll. The recording medium P is, for example, a label sheet in which two sheets are laminated via an adhesive layer, in the present embodiment. The recording medium P is transported by pairs of paper feeding rollers 11, 12, and 13 to a secondary transfer roller 33 mentioned below.

Note that the recording medium P may be a sheet-like medium.

The image forming section G includes, for example, a transfer unit 30 and image forming units 20Y, 20M, 20C, and 20K that form an image with respective colored toners of yellow (Y), magenta (M), cyan (C), and black (K). The image is formed, for example, on the basis of an image forming job (hereinafter, simply called "job"), which has been transmitted from an external device.

The image forming units 20Y, 20M, 20C, and 20K for Y, M, C, and K components have similar structures. Note that for convenience of illustration and description, the same signs are used for common structural components.

A structure of the image forming unit will be described by using the image forming unit 20Y.

The image forming unit 20Y includes, for example, an exposure unit 21, a developing unit 22, a photoreceptor 23, and a charging unit 24.

The charging unit 24 negatively charges the surface of the photoconductive photoreceptor 23 uniformly. Each of the exposure units 21 includes, for example, a semiconductor laser and irradiates a part of the corresponding photoreceptor 23, matching the image of the respective color components, with laser light. Electrostatic latent images of the respective color components are formed on the surfaces of the respective photoreceptors 23, due to the potential difference with the surroundings. The developing units 22 house developers of the corresponding color components, and form toner images by making the electrostatic latent images visible by adhering the toners of the respective color components onto the surfaces of the photoreceptors 23.

The transfer unit 30 includes, for example, an intermediate transfer belt 31, primary transfer rollers 32, a secondary transfer roller 33, driving rollers 34, driven rollers 35, and a belt cleaning unit not illustrated.

The intermediate transfer belt 31 includes an endless belt. The intermediate transfer belt 31 is stretched around the driving rollers 34 and the driven rollers 35. The intermediate transfer belt 31 travels in a direction illustrated by an arrow A at a fixed speed by the rotation of the driving rollers 34.

The toner images of each of the colors are sequentially overlapped on the intermediate transfer belt 31 to be primarily transferred by the intermediate transfer belt 31 being brought into pressure contact with the photoreceptors 23 by the primary transfer rollers 32. Then, the intermediate toner image primarily transferred onto the intermediate transfer belt 31 is secondarily transferred onto the recording medium P by the intermediate transfer belt 31 being brought into pressure contact with the recording medium P by the secondary transfer roller 33.

The fixing unit 40 fixes the toner image transferred onto the recording medium P.

The fixing unit 40 includes, for example, a heating roller 41 and a pressurizing roller 42 for sandwiching the recording medium P therebetween.

The heating roller 41 is heated to a predetermined temperature by a heater that is a heat source.

The pressurizing roller 42 is pressed against the heating roller 41 by an elastic member not illustrated. Heat and pressure are applied to the recording medium P, onto which the toner image has been transferred, by the recording medium P passing a nip part between the heating roller 41 and the pressurizing roller 42. The toner image is thereby melted and fixed.

The operation display unit 50 includes a display screen. The screen includes a display unit that displays various information on the screen and an operation unit used for various instructions to be input by a user.

The control unit 60 includes, for example, a central processing unit (CPU) and a random access memory (RAM). The CPU of the control unit 60 reads various programs such as a system program and a processing program, which are stored in the memory unit 70, and applies the programs in the RAM. The CPU executes various processing such as image forming processing, an adhesive removing process, and correction amount calculation processing, by following the applied programs. Details of the adhesive removing process and the correction amount calculation processing will be mentioned below.

The memory unit 70 includes, for example, a hard disk drive (HDD) or a non-volatile semiconductor memory.

The memory unit 70 stores various programs such as the system program and the processing program executed in the control unit 60, and data necessary for the control unit 60 to execute these programs. The memory unit 70, for example, stores setting information necessary for the control unit 60 to execute the various processing.

Figure 3A:
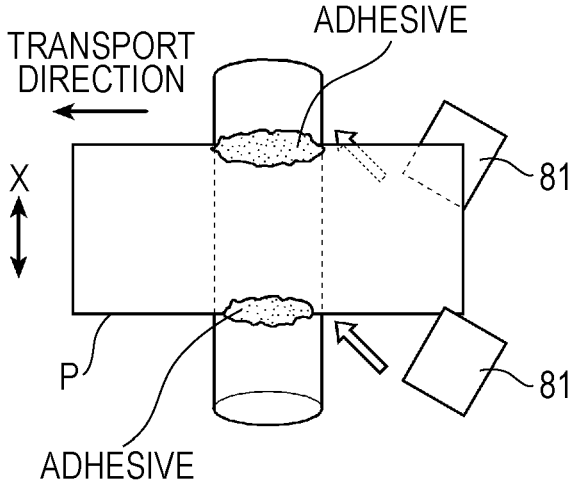
FIGS. 3A and 3B are diagrams describing a structure of a detection unit.
Figure 3B:
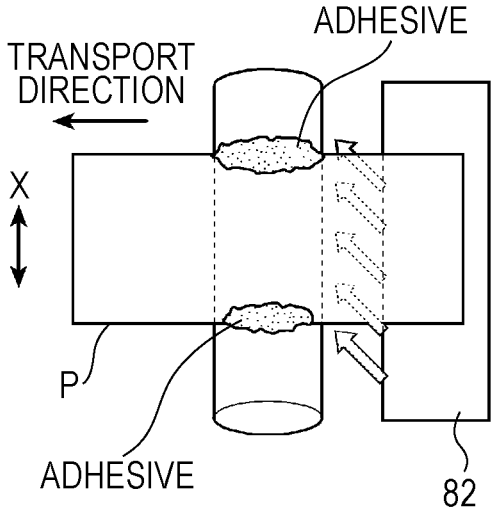

FIGS. 3A and 3B are diagrams describing a structure of the detection unit 80.

The detection unit 80 includes, for example, two sensors 81 placed at the corresponding edges on both sides of the recording medium P in the width direction (X direction) that is orthogonal to the transport direction, as illustrated in FIG. 3A.

The two sensors 81 are, for example, optical sensors. The two sensors 81 each detect an amount of an adhesive adhered (amount of adhesive) on a roller, beyond both edges of the recording medium P in the X direction. The roller is the target member to be detected (the pairs of paper feeding rollers 11, 12, and 13, the secondary transfer roller 33, and the pressurizing roller 42). The amount of the adhesive is detected at the nip part of the roller by control from the control unit 60 on the basis of output values of the two sensors 81.

The two sensors 81 include a moving mechanism that moves the two sensors 81 in the X direction. The positions of the two sensors 81 in the X direction are adjusted according to the size of the recording medium P in the X direction.

In addition, the detection unit 80 may include, for example, one long line sensor 82 extending along the X direction of the recording medium P, as illustrated in FIG. 3B. In this case, the part of the line sensor 82 to be used is selected according to the size of the recording medium P in the X direction.

In addition, the detection unit 80 can include a camera for capturing an image, instead of the two sensors 81 or the line sensor 82. In this case, the area of the adhesive is calculated by image analysis, and the amount of the adhesive can be detected from the area.

Figure 4:
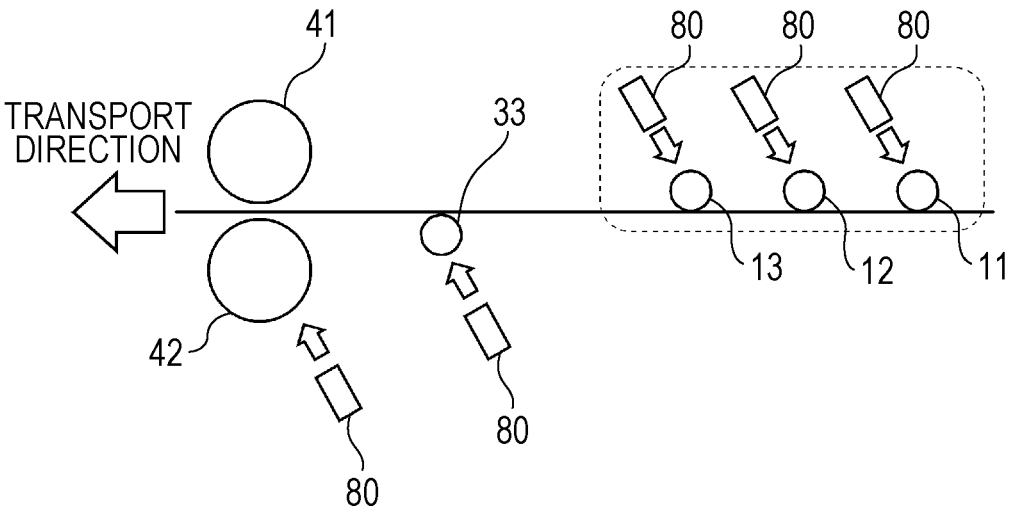
FIG. 4 is a diagram illustrating installation positions of the detection units.

FIG. 4 is a diagram illustrating installation positions of the detection units 80.

The detection units 80 are placed at multiple places on a transport route of the recording medium P, as illustrated in FIG. 2. The detection units 80 are placed with respect to, for example, the pairs of paper feeding rollers 11, 12, and 13, the secondary transfer roller 33, and the pressurizing roller 42.

In addition, the detection units 80 are placed at positions where the detection units 80 can directly detect parts to which the adhesive adheres on the rollers that are the target members to be detected (the pairs of paper feeding rollers 11, 12, and 13, the secondary transfer roller 33, and the pressurizing roller 42).

Figure 5:
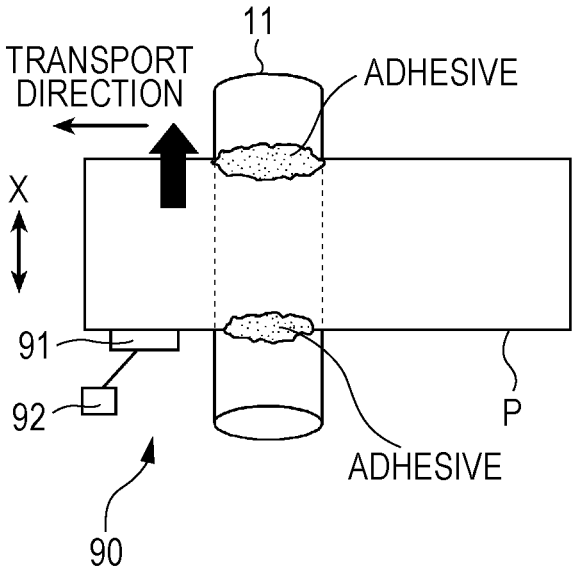
FIG. 5 is a diagram describing a movement of a recording medium moved by a steering mechanism.

FIG. 5 is a diagram describing a movement of the recording medium P moved by the steering mechanism 90.

The steering mechanisms 90 are placed at positions corresponding to the detection units 80 placed with respect to the pairs of paper feeding rollers 11, 12, and 13, and the pressurizing roller 42.

The steering mechanism 90 moves the recording medium P being transported in the X direction by the control from the control unit 60 as illustrated in FIG. 5. The recording medium P is moved on the basis of the amount of the adhesive detected by the detection unit 80. Therefore, the recording medium P can wipe the adhesive adhered on the transport path.

The steering mechanism 90 as a mechanism includes, for example, a screen part 91 placed at the edge of the recording medium P in the X direction, and a driving unit 92 that moves the screen part 91 in the X direction. A configuration in which the recording medium P is pushed in the X direction by moving the screen part 91 in the X direction by driving the driving unit 92, can be adopted. However, the mechanism can be any known mechanism other than this one.

Next, an operation of the image forming device 100 in the present embodiment will be described.

The image forming device 100 executes the adhesive removing process for removing the adhesive adhered on the transport path, during the image forming processing in the present embodiment. In the adhesive removing process, the recording medium P being transported is moved in the X direction by each of the steering mechanisms 90 on the basis of the amount of the adhesive detected by each of the detection units 80, thereby allowing the adhesive to be removed.

In addition, the image forming device 100 executes the correction amount calculation processing to calculate an amount for correcting an image density on the basis of the amount of the adhesive detected by all of the detection units 80.

Figure 6:
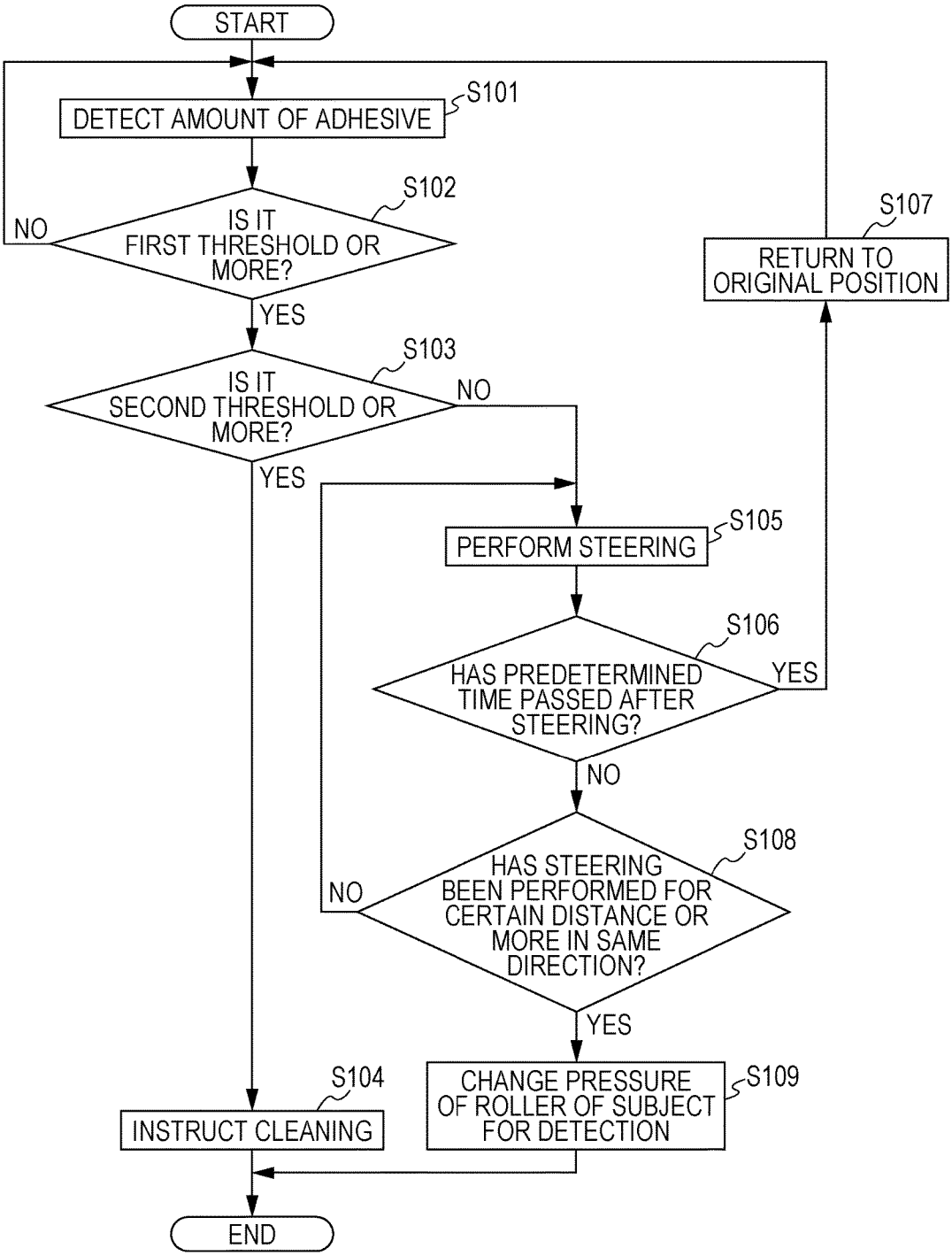
FIG. 6 is a flowchart illustrating an adhesive removing process.
Figure 7:
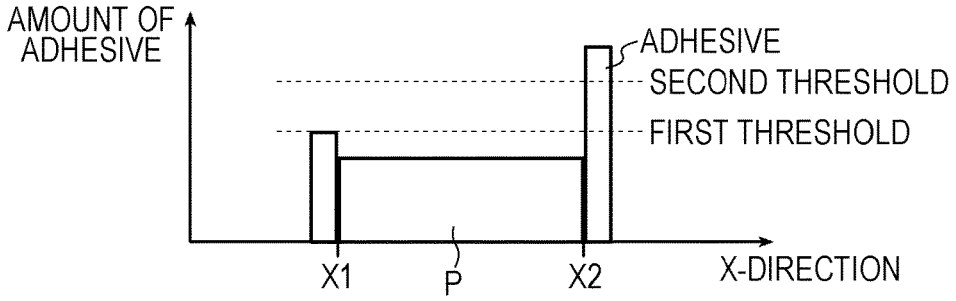
FIG. 7 is a diagram for describing a moving state of the recording medium in the adhesive removing process.
Figure 8A:
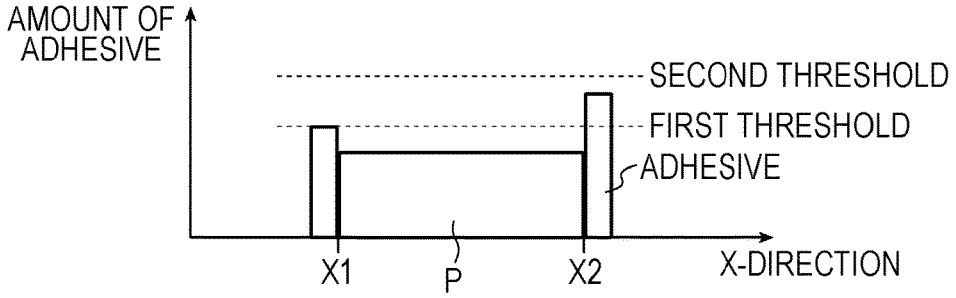
FIGS. 8A to 8C are diagrams for describing the moving state of the recording medium in the adhesive removing process.
Figure 8B:
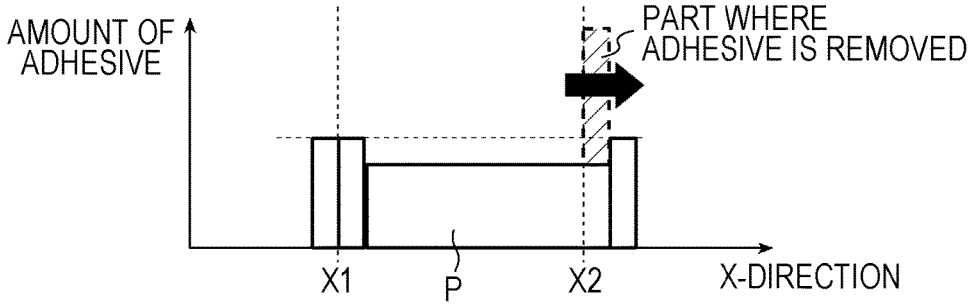
Figure 8C:
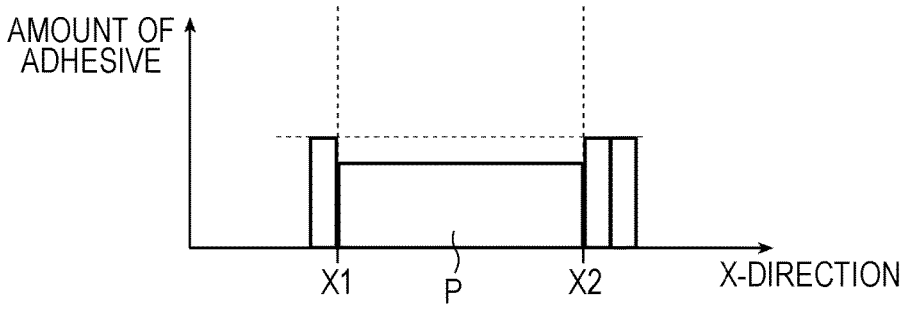

FIG. 6 is a flowchart illustrating the adhesive removing process.

Also, FIGS. 7 to 9C are diagrams for describing the moving state of the recording medium P in the adhesive removing process. FIGS. 7 to 9C illustrate the position of the recording medium P in the lateral direction and the amount of the adhesive in the vertical direction, and describe the moving state of the recording medium P corresponding to the amount of the adhesive. Also, X1 denotes a reference position (position before moving) of a near side and X2 denotes a reference position (position before moving) of a far side of the recording medium P in the X direction.

Note that the adhesive removing process is performed at each steering mechanism 90 while the recording medium P is transported from the paper feeding unit 10 to the fixing unit 40 for the image forming processing.

First, the control unit 60 detects the amount of the adhesive by using the detection unit 80 (step S101). To be specific, the control unit 60 detects, by using the detection unit 80, the amount of the adhesive adhered on a roller, which is the target to be detected, beyond the recording medium P in both edges of the recording medium P in the X direction.

Next, the control unit 60 determines whether the amount is a predetermined first threshold or more (step S102). If the amount is below the first threshold (NO in step S102), the control unit 60 repeats the processing of step S102.

The first threshold is a value that represents a reference of the amount of the adhesive, for the steering to be performed.

On the other hand, if the amount is the first threshold or more (YES in step S102), the control unit 60 determines whether the amount is a predetermined second threshold or more, which is larger than the first threshold (step S103).

The second threshold is considered to be a reference value indicating that the removing of the adhesive by the steering is impossible. That is to say, the second threshold indicates that the amount of the adhesive is too much and the adhesive cannot be removed simply by being wiped by the recording medium P.

When the amount is the second threshold or more (refer to FIG. 7) (YES in step S103), the control unit 60 instructs a user to clean (step S104) and finishes this processing.

The cleaning instruction for the user is achieved by, for example, a message being displayed on the display screen of the operation display unit 50.

On the other hand, if the amount is below the second threshold (refer to FIG. 8A) (NO in step S103), the control unit 60 performs the steering to move the recording medium P to the side where the adhesive in an amount of the first threshold or more is adhered (refer to FIG. 8B) (step S105).

As a result, the part shifted from the reference position of the recording medium P wipes the adhesive present in the transport direction (broken line in FIG. 8B), whereby the adhesive is removed.

Next, the control unit 60 determines whether a predetermined time has passed after the steering (step S106). When the predetermined time has passed (YES in step S106), the control unit 60 makes the recording medium P return to the original position (refer to FIG. 8C) (step S107). Thereafter, the control unit 60 returns to step S101 mentioned above and repeats the process after step S101.

On the other hand, when the predetermined time has not passed (NO in step S106), the control unit 60 determines whether the recording medium P has moved a fixed distance or more in the same direction, i.e., reached a limit position where the steering is possible (step S108).

Figure 9A:
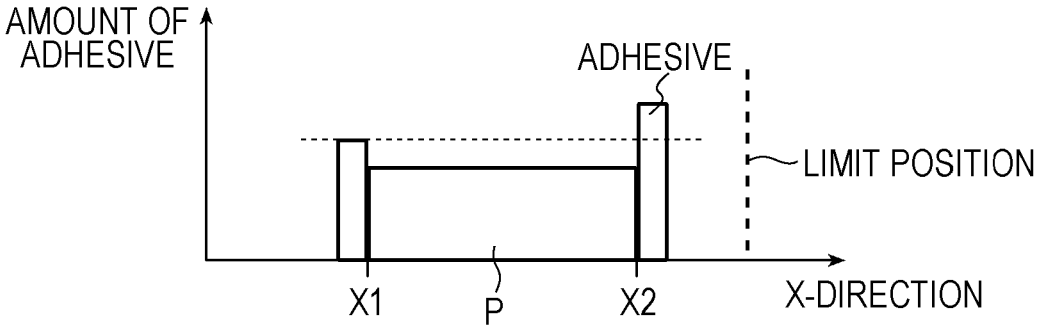
FIGS. 9A to 9C are diagrams for describing the moving state of the recording medium in the adhesive removing process.
Figure 9B:
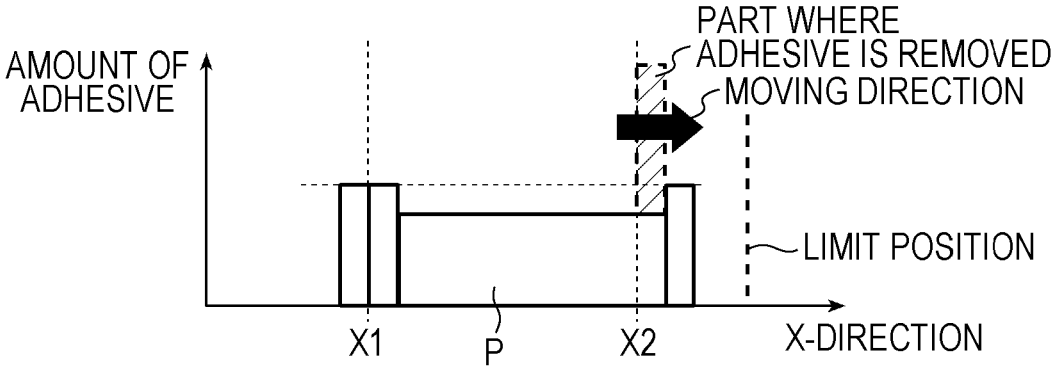
Figure 9C:
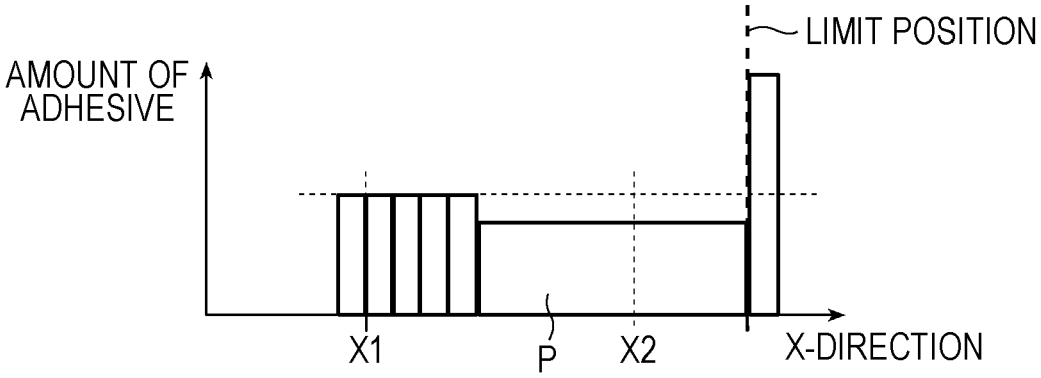

When the recording medium P has not reached the limit position (refer to FIG. 9A) (NO in step S108), the control unit 60 returns to step S105 mentioned above and repeats the process after step S105 (refer to FIG. 9B).

On the other hand, when the recording medium P has reached the limit position (refer to FIG. 9C) (YES in step S108), the control unit 60 changes the pressure of the roller that is the target to be detected (step S109), and finishes this processing.

Note that step S109 mentioned above has been described with an example of the configuration in which the pressure of the roller that is the target to be detected changes. However, a cleaning instruction may be given to a user, instead.

As mentioned above, in the present embodiment, the recording medium P transported in the image forming processing wipes the adhesive by being steered by each of the steering mechanisms 90 placed with respect to the pairs of paper feeding rollers 11, 12, and 13 and the pressurizing roller 42 by the adhesive removing process being performed.

Note that the adhesive will be adhered on the recording medium P by the process. However, this does not cause any effect since the adhesive will be adhered on the edges of the recording medium P.

Figure 10:
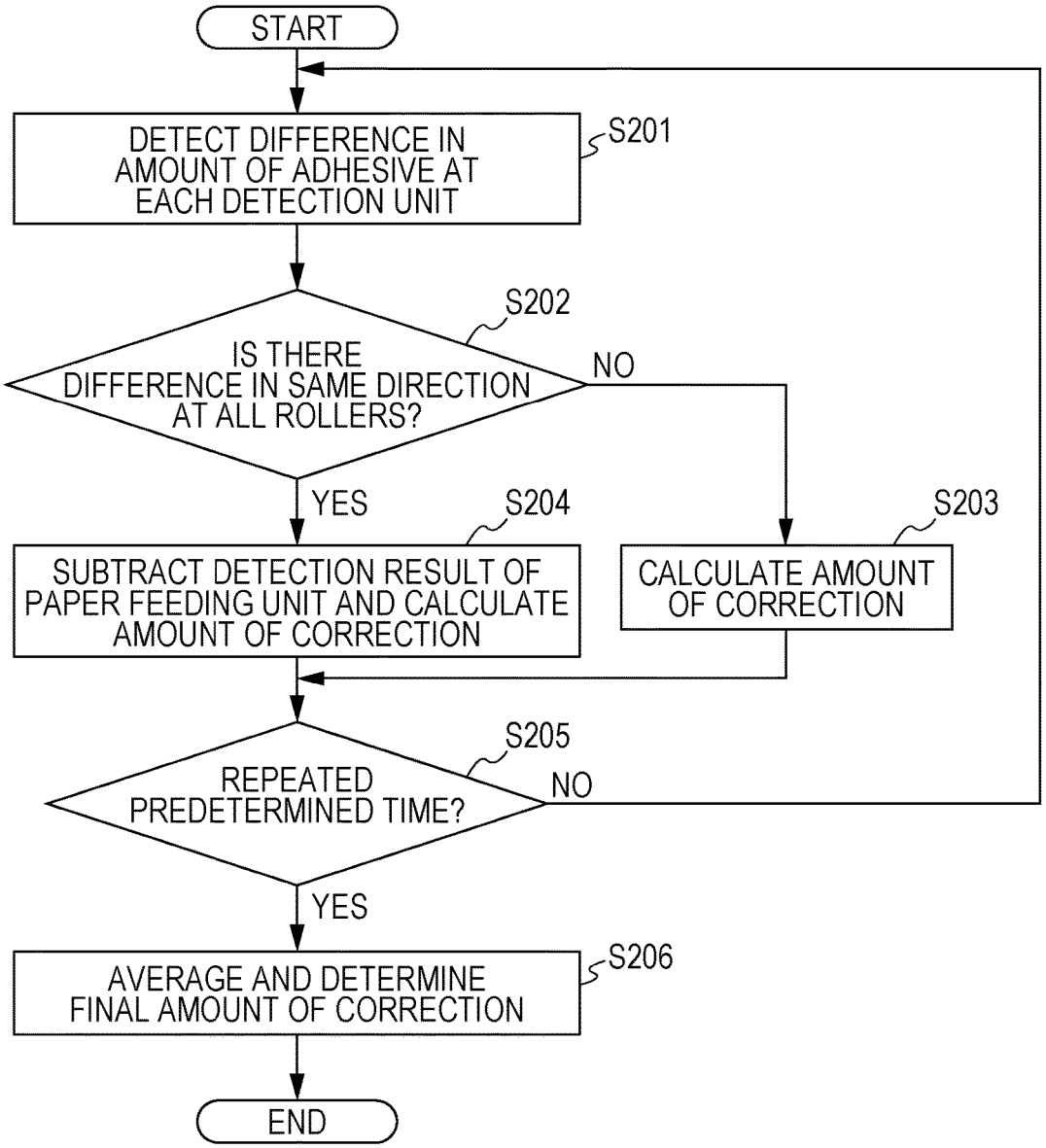
FIG. 10 is a flowchart illustrating correction amount calculation processing.

FIG. 10 is a flowchart illustrating the correction amount calculation processing.

The correction amount calculation processing is performed after one recording medium P is transported from the paper feeding unit 10 to the fixing unit 40 for the image forming processing, and the amount of the adhesive on both edges of the one recording medium P is detected by all of the detection units 80.

First, the control unit 60 calculates the difference in the amount of the adhesive between the near side and the far side in the X direction at each of the rollers corresponding to the detection units 80 from the detection result at each of the detection units 80 (step S201).

Next, the control unit 60 determines whether the difference is in the same direction at all of the rollers (step S202).

To be specific, the control unit 60 determines whether there is a directional tendency in which there is a large amount of adhesive at the near side compared with the far side in the X direction, or vice versa, at all of the rollers.

The determination is processing for estimating where the cause of the difference in the amount of the adhesive is. The condition of the adhesive applied onto the recording medium P or environment outside the device is considered to be the cause when there is a difference in the same direction at all of the rollers.

The roller with the difference is considered to be the cause when the difference is not in the same direction.

Note that the determination made here is as to whether there is a difference in the same direction at all of the rollers. However, determination may be made as to whether there is a difference in the same direction at a predetermined number of rollers among all of the rollers.

When the difference is not in the same direction (NO instep S202), the control unit 60 calculates the correction amount from the difference in the amount of the adhesive detected at the detection unit 80 placed for the secondary transfer roller 33 (step S203).

Figure 11A:
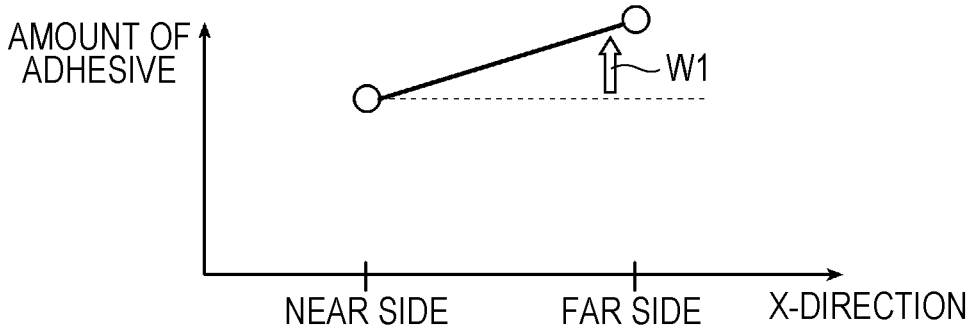
FIG. 11A is a diagram illustrating one example of an adhesion amount of an adhesive at near and far sides of the recording medium in a secondary transfer roller.
Figure 11B:
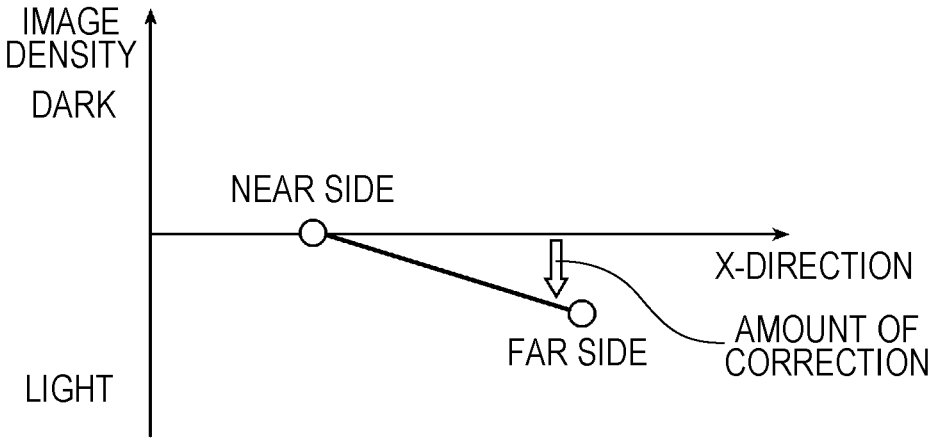
FIG. 11B is a diagram illustrating one example of a correction amount based on FIG. 11A.

FIG. 11A is a diagram illustrating one example of the amount of the adhesive adhered at the near and far sides of the recording medium P detected at the detection unit 80 placed for the secondary transfer roller 33. FIG. 11B is a diagram illustrating one example of the correction amount of the image density at the near and far sides of the recording medium P based on FIG. 11A.

In FIG. 11A, the amount of the adhesive is larger by W1 at the far side than at the near side of the recording medium P. In other words, W1 is the difference in the amount of the adhesive.

In this case, as illustrated in FIG. 11B, the pressure of the secondary transfer roller 33 corresponding to the far side of the recording medium P is considered to be the cause of the difference in the amount of the adhesive. Here, the difference W1 in the amount of the adhesive is converted into the image density and the correction amount is calculated.

Figure 12A:
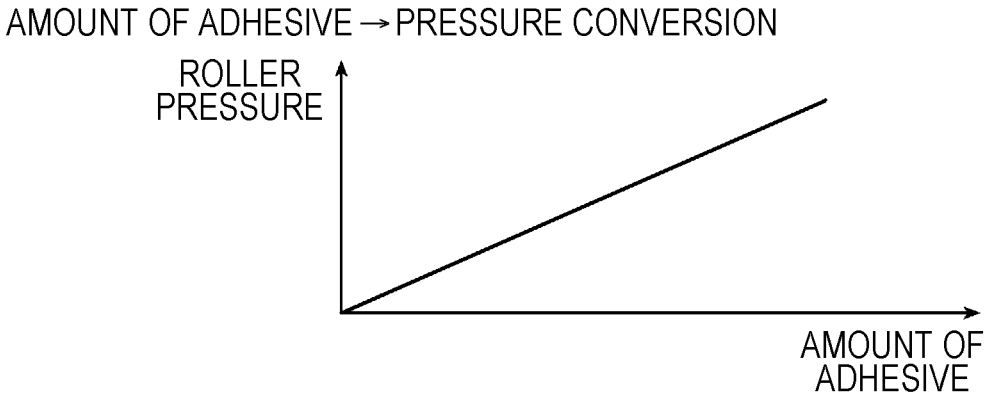
FIGS. 12A and 12B are diagrams for describing a method of converting the adhesion amount of an adhesive into an image density.
Figure 12B:
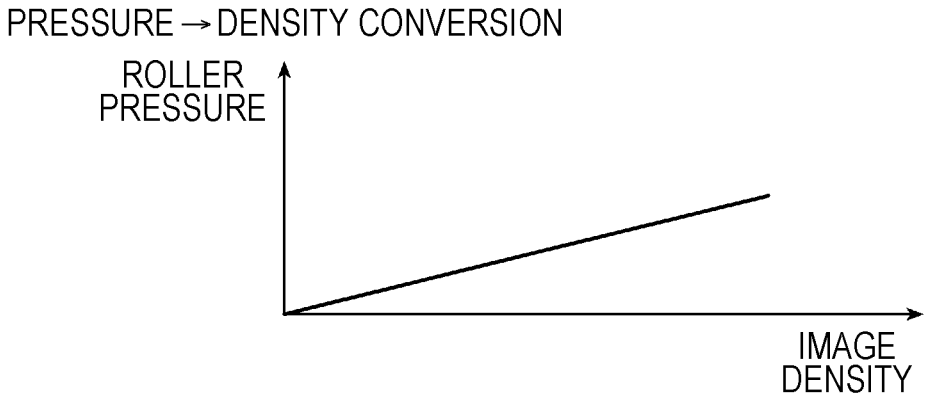

FIGS. 12A and 12B are diagrams for describing a method of converting the difference W1 in the amount of the adhesive into the image density.

First, the amount of the adhesive (the difference W1 in the amount of the adhesive) is converted into a roller pressure by using conversion data in FIG. 12A. Next, the roller pressure is converted into the image density by using the conversion data in FIG. 12A.

The conversion data illustrated in FIGS. 12A and 12B are stored beforehand in the memory unit 70 as setting information.

When there is the difference in the same direction (YES in step S202) in FIG. 10, the control unit 60 calculates the correction amount of the image density by subtracting the amount of the adhesive detected at the detection units 80 placed for the pairs of paper feeding rollers 11, 12, and 13 from the amount of the adhesive detected at the detection unit 80 placed for the secondary transfer roller 33 (step S204).

Figure 13A:
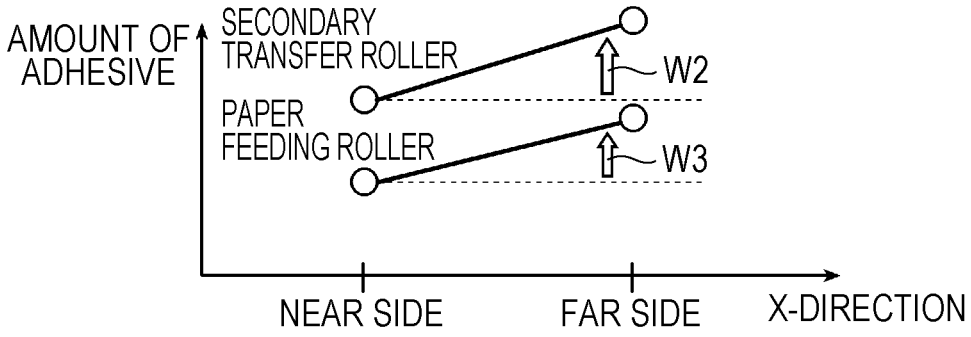
FIG. 13A is a diagram illustrating one example of an adhesion amount of the adhesive at near and far sides of the recording medium in the secondary transfer roller and a pair of paper feeding rollers.
Figure 13B:
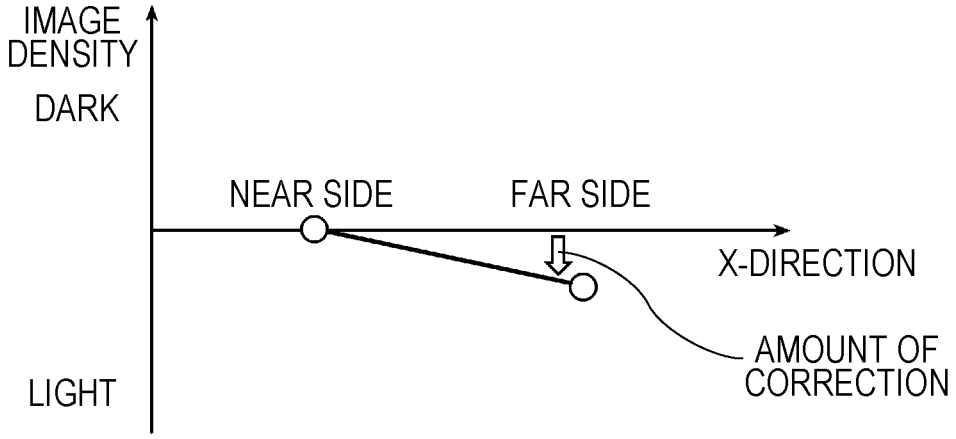
FIG. 13B is a diagram illustrating one example of a correction amount based on FIG. 13A.

FIG. 13A is a diagram illustrating one example of the amount of the adhesive adhered at the near and far sides of the recording medium P detected at the detection units 80 placed for the secondary transfer roller 33 and the pair of paper feeding rollers 11. FIG. 13B is a diagram illustrating one example of the correction amount of the image density at the near and far sides of the recording medium P based on FIG. 13A.

In FIG. 13A, the amount of the adhesive is larger by W2 at the far side than at the near side of the recording medium P at the detection unit 80 placed for the secondary transfer roller 33. In other words, W2 is the difference in the amount of the adhesive.

The amount of the adhesive is larger by W3 at the far side than at the near side of the recording medium P at the detection unit 80 placed for the pair of paper feeding rollers 11. In other words, W3 is the difference in the amount of the adhesive.

In this case, the difference W2 in the amount of the adhesive in the secondary transfer roller 33 is divided by the difference W3 in the amount of the adhesive in the pair of paper feeding rollers 11. The resultant value is the amount of the adhesive causing a substantial effect on the secondary transfer roller 33 (substantial amount of adhesive W4). Accordingly, the substantial amount of the adhesive W4 is converted into the image density and the correction amount is calculated.

Note that the calculation of the substantial amount of the adhesive W4 by using the difference in the amount of the adhesive at the pair of paper feeding rollers 11 (the difference W3 in the amount of the adhesive) has been described. However, it is preferable, in view of accuracy, to use an average value of the amounts of the adhesive detected at the pairs of paper feeding rollers 11, 12, and 13, for the calculation of the substantial amount of the adhesive W4.

Note that as a method of converting the substantial amount of the adhesive W4 into the image density, FIGS. 12A and 12B mentioned above can be used similarly to step S203 mentioned above.

Next, the control unit 60 determines whether processing of steps S201 to S204 mentioned above has been repeated a predetermined number of times, in other words, whether the correction amount has been calculated for a predetermined number of the recording media P (step S205). When the predetermined number of times is not satisfied (NO in step S205), the control unit 60 returns to step S201 mentioned above and repeats the processing after step S201.

On the other hand, when the processing is repeated the predetermined number of times (YES in step S205), the control unit 60 determines a final correction amount, which is an average value of the predetermined number of the correction amounts (step S206).

Thereafter, the control unit 60 performs correction processing of the image density, for example, exposure amount control and density gradation control by using the final correction amount.

The correction amount is calculated on the basis of the difference in the amount of the adhesive, and the image density is corrected as mentioned above in the present embodiment.

In the present embodiment, as mentioned above, the image forming device includes the image forming section G configured to form an image onto the recording medium P in which sheets are laminated via an adhesive layer, the detection unit 80 configured to detect an amount of an adhesive adhered beyond both edges of the recording medium P in the X direction, and the control unit 60 configured to calculate a correction amount for correcting an image formation condition for the image forming section G on the basis of a difference in the amount of the adhesive between both edges of the recording medium P in the X direction detected by the detection unit 80.

Therefore, there is no need to install various sensors, and good image quality and transport stability can be achieved with a small number of components.

In addition, in the present embodiment, the image forming device includes the paper feeding unit 10 configured to feed the recording medium P to the image forming section G, the detection units 80 are included in the image forming section G and the paper feeding unit 10, and the control unit 60 calculates the correction amount by subtracting an amount of an adhesive detected by the detection unit 80 included in the paper feeding unit 10 from an amount of an adhesive detected by the detection unit 80 included in the image forming section G when all of the detection units 80 at the image forming section G and the paper feeding unit 10 detect a larger amount of an adhesive at an edge on the same side of the recording medium P in the X direction.

Therefore, the correction amount can be calculated more accurately because the amount of the adhesive adhered beyond the recording medium P (amount of adhesive) caused from the environment is subtracted.

In addition, in the present embodiment, the paper feeding unit 10 includes the plurality of detection units 80, and the control unit 60 calculates the correction amount by subtracting an average value of amounts of an adhesive detected by the detection units 80 in the paper feeding unit 10 from an amount of an adhesive detected by the detection unit 80 included in the image forming section G.

Therefore, the amount of the adhesive adhered beyond the recording medium P (amount of adhesive) caused from the environment can be calculated accurately.

In addition, in the present embodiment, the control unit 60 calculates the correction amount for a plurality of the recording media P and determines, as a final correction amount, an average value of the correction amounts calculated for the plurality of recording media P.

Therefore, the image formation condition for the image forming section G can be more accurately corrected.

In addition, in the present embodiment, the detection unit 80 includes the line sensor 82 extending in the X direction of the recording medium P.

Therefore, recording media P in various sizes can be used without including a plurality of sensors or a mechanism that moves the sensors.

In addition, in the present embodiment, the detection unit 80 is placed at a position where the detection unit 80 can detect a part of the target member to be detected (the pairs of paper feeding rollers 11, 12, and 13, the secondary transfer roller 33, and the pressurizing roller 42) to which the adhesive is adhered beyond both edges of the recording medium P in the X direction.

Therefore, the amount of the adhesive can be detected more accurately by the detection unit directly detecting the part of the target member to be detected to which the adhesive is adhered.

In addition, in the present embodiment, the image forming device further includes the steering mechanism 90 configured to move the recording medium P in the X direction, and the control unit 60 moves the recording medium P in a direction in which an amount of an adhesive exceeds a first threshold, by the steering mechanism 90 when the amount of the adhesive detected by the detection unit 80 exceeds the first threshold.

Therefore, the recording medium P being transported can wipe the adhesive.

In addition, in the present embodiment, the control unit 60 makes the recording medium P return to an original position by the steering mechanism 90 when a predetermined time has passed since the recording medium P has been moved.

Therefore, the control unit can prevent the recording medium P from excessively deviating in the X direction.

In addition, in the present embodiment, the image forming device further includes the pairs of rollers (pairs of paper feeding rollers 11, 12, and 13, the secondary transfer roller 33, and the pressurizing roller 42) configured to sandwich the recording medium P therebetween and transport the recording medium P, the detection units 80 are placed with respect to the pairs of rollers, and the control unit 60 changes a nip pressure of the pairs of rollers when the recording medium P is moved for a fixed distance or more in the same direction by the steering mechanism 90.

Therefore, it is possible to prevent a large amount of the adhesive from adhering beyond the recording medium P on one side thereof in the X direction by changing the nip pressure of the pair of rollers.

In addition, in the present embodiment, the image forming device further includes the operation display unit 50 configured to notify a user of a predetermined message, and the control unit 60 prompts the user to clean by using the operation display unit 50 when the recording medium P is moved for a fixed distance or more in the same direction by the steering mechanism 90.

Therefore, the operation display unit 50 can notify the user that a large amount of the adhesive is adhered on one side of the recording medium P in the X direction, and prompt the user to clean.

In addition, in the present embodiment, the image forming device further includes the operation display unit 50 configured to notify a user of a predetermined message, and the control unit 60 prompts the user to clean by using the operation display unit 50 when an amount of an adhesive detected by the detection unit 80 exceeds the second threshold larger than the first threshold.

Therefore, the operation display unit 50 can notify the user that a large amount of the adhesive is adhered on one side of the recording medium P in the X direction, and prompt the user to clean.

Note that the processing of steps S201 to S204 mentioned above is repeated a predetermined number of times and the final correction amount is determined by use of an average, i.e., the average of the correction amounts of the predetermined number in the flowchart in FIG. 10 mentioned above. However, the configuration may not repeat the processing of steps S201 to S204 mentioned above a predetermined number of times as illustrated in the flowchart in FIG. 14.

Figure 14:
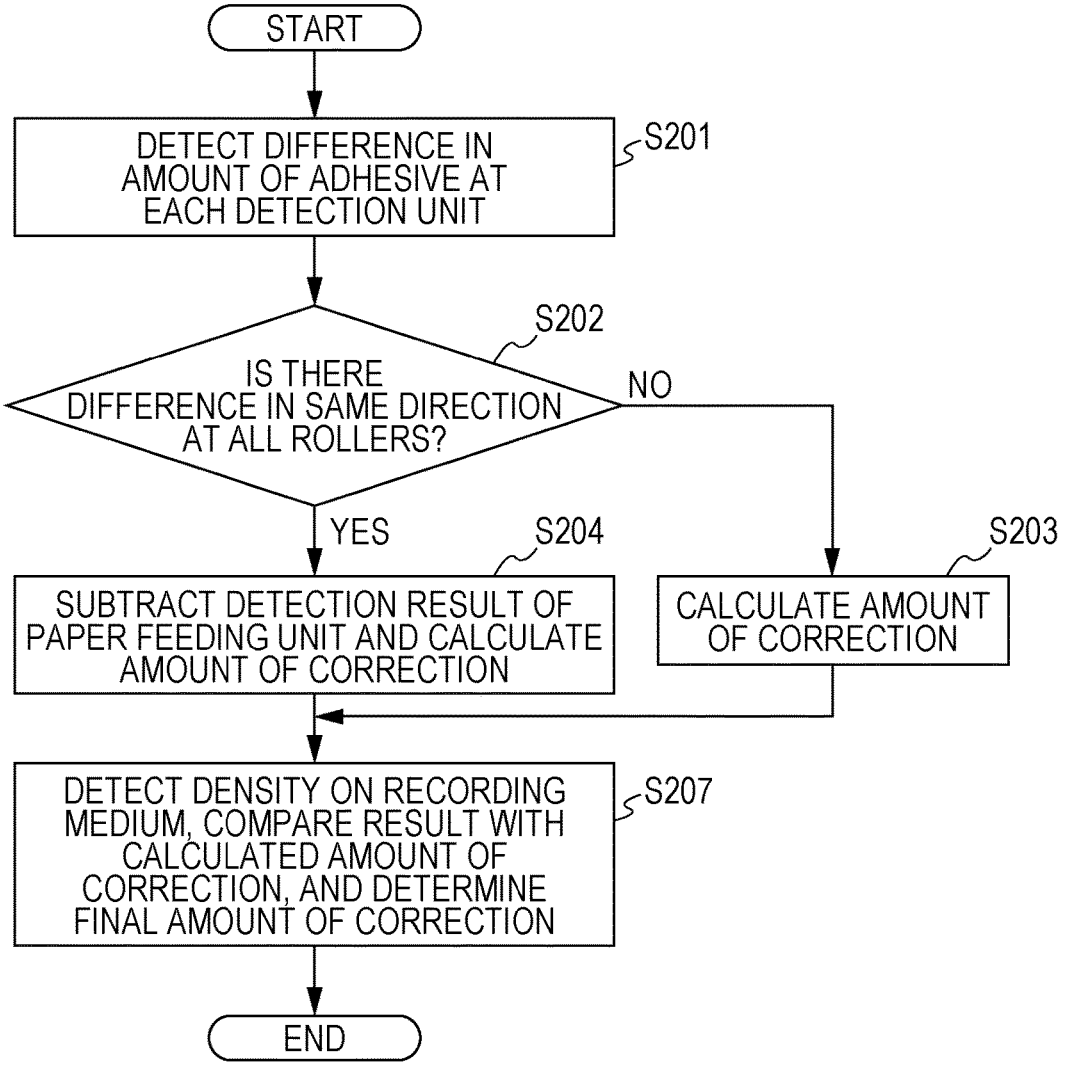
FIG. 14 is a flowchart illustrating correction amount calculation processing of another aspect.

In FIG. 14, the same processing as FIG. 10 is executed from steps S201 to S204.

Thereafter, the control unit 60 detects the density of an image formed on the recording medium P by a density sensor (not illustrated) placed downstream of the secondary transfer roller 33, compares the result with the correction amount calculated at step S203 or S204 mentioned above, and determines a final correction amount (step S207).

With this configuration, a correction accuracy can be ensured without repeating the processing of steps S201 to S204 mentioned above a predetermined number of times.

Note that in view of further increasing the accuracy, the processing of steps S201 to S204 mentioned above is repeated a predetermined number of times in the flowchart in FIG. 10 mentioned above and the final correction amount is determined by use of the result of the density sensor in the flowchart in FIG. 14 mentioned above. However, it is possible to omit any of these.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming device comprising:

an image forming section configured to form an image onto a recording medium in which sheets are laminated via an adhesive layer;

a detection unit configured to detect an amount of an adhesive adhered beyond both edges of the recording medium in a width direction orthogonal to a transport direction; and a control unit configured to calculate a correction amount for correcting an image formation condition for the image forming section on the basis of a difference in the amount of the adhesive on both edges of the recording medium in the width direction detected by the detection unit.

2. The image forming device according to claim 1, further comprising a paper feeding unit configured to feed the recording medium to the image forming section, wherein the detection units are included in the image forming section and the paper feeding unit, and the control unit calculates the correction amount by subtracting an amount of an adhesive detected by the detection unit included in the paper feeding unit from an amount of an adhesive detected by the detection unit included in the image forming section when a predetermined number of the detection units at the image forming section and the paper feeding unit detect a larger amount of an adhesive at an edge on the same side of the recording medium P in the width direction.

3. The image forming device according to claim 2, wherein the paper feeding unit includes a plurality of the detection units, and the control unit calculates the correction amount by subtracting an average value of amounts of an adhesive detected by the plurality of detection units in the paper feeding unit from an amount of an adhesive detected by the detection unit included in the image forming section.

4. The image forming device according to claim 1, wherein the control unit calculates the correction amount for a plurality of the recording media and determines, as a final correction amount, an average value of the correction amounts calculated for the plurality of recording media.

5. The image forming device according to claim 1, wherein the detection unit includes a line sensor extending in the width direction of the recording medium.

6. The image forming device according to claim 1, wherein the detection unit is placed at a position enabling detection of a part of a target member to be detected to which the adhesive is adhered beyond both edges of the recording medium in the width direction.

7. The image forming device according to claim 1, further comprising a steering mechanism configured to move the recording medium in the width direction, wherein the control unit moves the recording medium in a direction in which an amount of an adhesive detected by the detection unit exceeds a first threshold, by the steering mechanism when the amount of the adhesive exceeds the first threshold.

8. The image forming device according to claim 7, wherein the control unit makes the recording medium return to an original position by the steering mechanism when a predetermined time has passed since the recording medium has been moved.

9. The image forming device according to claim 7, further comprising a pair of rollers configured to sandwich the recording medium therebetween and transport the recording medium, wherein the detection unit is placed with respect to the pair of rollers, and the control unit changes a nip pressure of the pair of rollers when the recording medium is moved for a fixed distance or more in the same direction by the steering mechanism.

10. The image forming device according to claim 7, further comprising a notification unit configured to notify a user of a predetermined message, wherein the control unit prompts the user to clean by using the notification unit when the recording medium is moved for a fixed distance or more in the same direction by the steering mechanism.

11. The image forming device according to claim 7, further comprising a notification unit configured to notify a user of a predetermined message, wherein the control unit prompts the user to clean by using the notification unit when an amount of an adhesive detected by the detection unit exceeds a second threshold larger than the first threshold.

* * * * *